United States Patent [19]

Oxman

[11] 4,454,904

[45] Jun. 19, 1984

[54] STRIP CURTAIN FOR DISPLAY CASES

[75] Inventor: Jack Oxman, Newport Beach, Calif.

[73] Assignee: Johnston Environmental Corporation, Santa Ana, Calif.

[21] Appl. No.: 385,924

[22] Filed: Jun. 7, 1982

[51] Int. Cl.[3] ..... A47H 23/05; A47H 1/00

[52] U.S. Cl. ..... 160/332

[58] Field of Search ..... 160/327, 328, 329, 332, 160/184, 392, 395; 24/201 C, 243 K; 248/317; 160/332

[56] References Cited

U.S. PATENT DOCUMENTS

| | | | |
|---|---|---|---|
| 2,287,667 | 6/1942 | Brown | 160/392 X |
| 3,064,723 | 11/1962 | Paillard et al. | 160/197 X |
| 3,854,517 | 12/1974 | Nakamura | 160/321 |
| 4,186,790 | 2/1980 | Schenker | 160/329 |
| 4,312,396 | 1/1982 | McKinnon et al. | 160/332 |
| 4,313,485 | 2/1982 | Gidge et al. | 160/332 |
| 4,388,961 | 6/1983 | Schaefer et al. | 160/332 |

*Primary Examiner*—Peter M. Caun
*Assistant Examiner*—Cherney S. Lieberman
*Attorney, Agent, or Firm*—Gordon L. Peterson

[57] ABSTRACT

A strip curtain for use over the opening of a display case comprising an elongated upper mounting member, a plurality of elongated flexible strips and a lower mounting member. Each of the strips includes a bead adjacent an upper end and the upper mounting member has an elongated groove for slidably receiving the beads so that the strips can extend from the upper mounting member with the longitudinal edges of the strips being adjacent. The lower ends of the strips are attached to the lower mounting member. An upper mounting member with the strips attached thereto can be hung on an adjacent mounting member to provide a large opening through the strip curtain for loading the display case.

5 Claims, 4 Drawing Figures

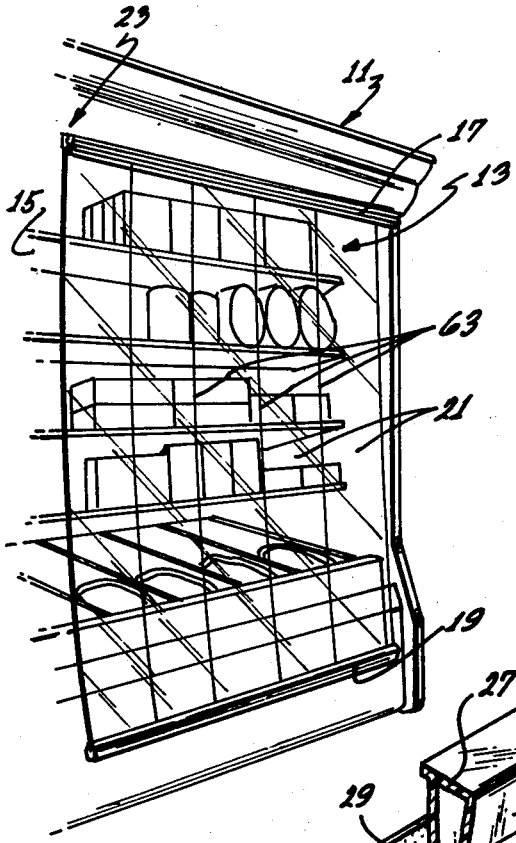
Fig. 1
Fig. 2
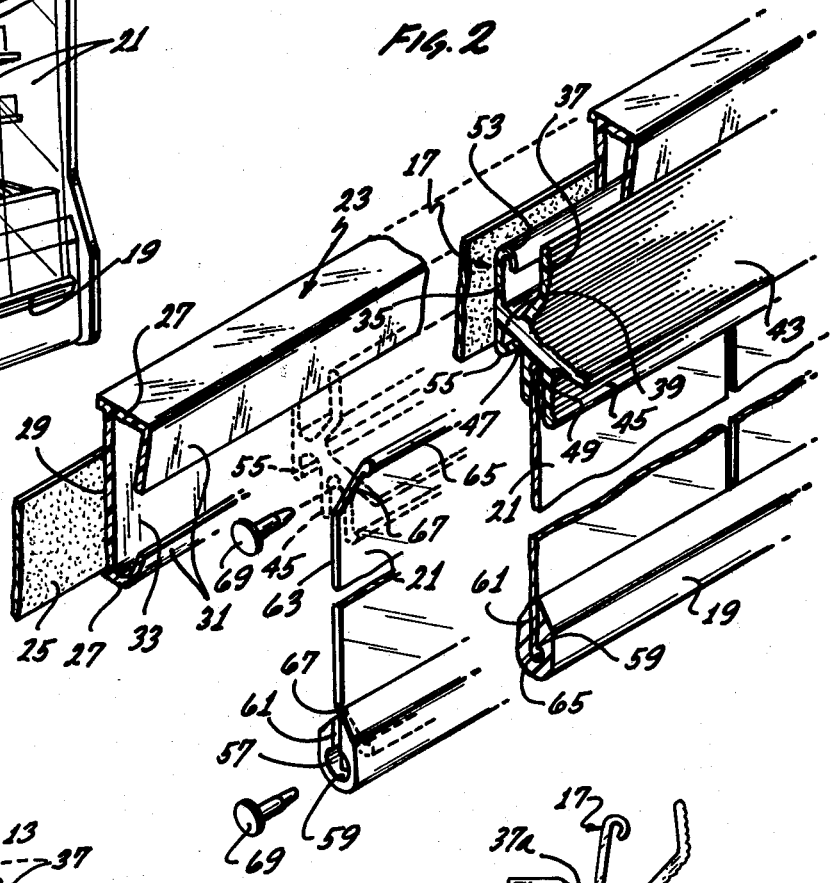
Fig. 3
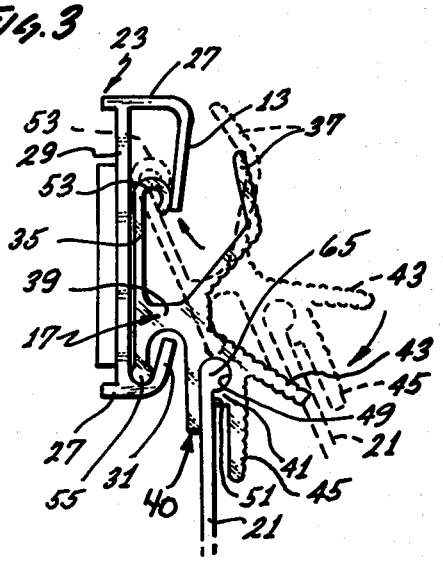
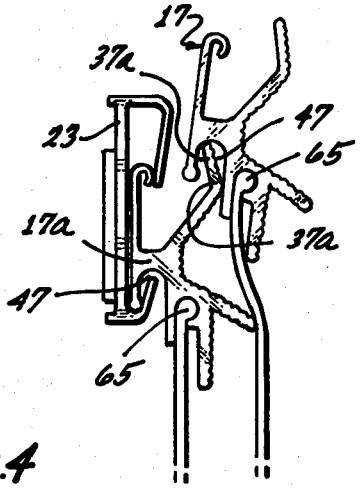
Fig. 4

STRIP CURTAIN FOR DISPLAY CASES

BACKGROUND OF THE INVENTION

Refrigerated cases, such as the type commonly found in retail food stores, commonly have horizontal or vertical openings to enable products to be loaded into and removed from the case. To conserve energy, the openings in these cases should be closed, and one way to accomplish this is with a strip curtain.

A typical strip curtain includes a plurality of flexible plastic strips appropriately mounted over an opening. Strip curtains of this type are known and are shown, by way of example, in Gidge et al U.S. Pat. No. 4,313,485, Schenker et al U.S. Pat. No. 4,186,790, and Mitchell U.S. Pat. No. 2,041,258.

It is desirable to use strip curtains for closing the openings of refrigerated cases because product can be easily removed from the case between the strips, and the strips automatically close after product has been removed. Unfortunately, if one of the strips becomes cut or damaged, it is difficult or impossible to quickly replace the damaged strip. It is also desirable to provide for temporary removal of a large number of the strips to provide a large opening into the refrigerated case for loading the case.

SUMMARY OF THE INVENTION

The strip curtain of this invention employs a plurality of elongated flexible strips and an elongated upper mounting member. The upper mounting member and the upper ends of the strips are releasably interlocked to mount the strips on the upper mounting member. This can be quickly and easily accomplished with inexpensive components by providing a bead adjacent the upper end of each of the strips and an elongated groove in the mounting member for slidably receiving the beads. Accordingly, the beads can be slid into the groove of the upper mounting member and the strips can extend from the upper mounting member with the longitudinal edges of adjacent strips being adjacent. To better control the lower ends of the strips, a lower mounting member may be attached to the lower ends of the strips.

Although the groove and bead can be of various different constructions, preferably the groove has at least one open end. With this arrangement, the beads can be slid into the groove from the open end.

The strips are typically constructed of flexible transparent plastic material. It has been found that strips, particularly longer strips, have a natural curvature. In the interest of providing optimum appearance characteristics in a retail environment, the strips should be arranged so that the natural curvature of each of the strips on the mounting members extends in the same direction.

To accomplish this, this invention insures that each of the strips will be inserted into the groove of the upper mounting member in the same direction. Thus, the invention provides means for inhibiting the insertion of the strips into the groove from the opening of the groove in one direction. In a preferred construction, the bead of each strip is joined to an adjacent portion of the strip, and the bead is enlarged relative to such adjacent portion and offset from it. This construction makes it difficult or impossible to insert the bead into the groove in the wrong way.

The mounting member is mounted on suitable supporting structure, such as the refrigerated display case itself. Although this can be accomplished in different ways, it is preferred to use an elongated strip curtain support which is adapted for attachment to the supporting structure. To facilitate removal of the upper mounting member from the strip curtain support, these members are constructed so that the upper mounting member can be demounted from the strip curtain support in response to predetermined relative movement between the upper mounting member and the strip curtain support.

Typically, a plurality of the upper mounting members are provided in end-to-end relationship on the refrigerated case. Another feature of this invention is that the upper mounting members are so constructed that one of them can be removed and hung on an adjacent upper mounting member. Of course, this feature of the invention can be used regardless of the particular construction and arrangement of the flexible strips. By hanging one upper mounting member on another mounting member, a large region of the refrigerated case is open to permit loading of the case.

The invention, together with additional features and advantages thereof, may best be understood by reference to the following description taken in connection with the accompanying illustrative drawing.

BRIEF DESCRIPTION OF THE DRAWINGS

FIG. 1 is a fragmentary isometric view of a strip curtain constructed in accordance with the teachings of this invention installed on a refrigerated display case.

FIG. 2 is an exploded isometric view of the strip curtain.

FIG. 3 is an end elevational view of an upper portion of the strip curtain showing how the upper mounting member can be installed on the strip support.

FIG. 4 is a fragmentary end elevational view showing how one section of the strip curtain can be hung on the upper mounting member of another section of the strip curtain.

DESCRIPTION OF THE PREFERRED EMBODIMENT

FIG. 1 shows a refrigerated display case 11 having a strip curtain 13 of this invention installed thereon. Although the display case 11 can be of various different constructions, in the form shown in FIG. 1, it is in the form of a free-standing case having a vertical opening 15 which is covered by the strip curtain 13.

The strip curtain 13 generally comprises an upper mounting member 17, a lower mounting member 19 and a plurality of elongated flexible strips 21. In addition, the strip curtain includes an elongated strip curtain support 23. The strip curtain support 23 is suitably attached to supporting structure, such as the display case 11, above the opening 15. Although the strip curtain support 23 can be attached to the case 11 in different ways, such as by Velcro, in the embodiment illustrated, this is accomplished by a pressure sensitive adhesive strip 25.

Although the strip curtain support 23 can be of various different constructions, in the embodiment illustrated, it is an elongated extrusion of rigid plastic material and it comprises flanges 27 integrally joined by a web 29 with the flanges 27 having their outer end portions 31 extending toward each other but being separated to define an elongated slot 33.

The upper mounting member 17 and the lower mounting member 19 are also preferably extruded from a rigid plastic material. In the embodiment illustrated, the upper mounting member 17 includes a generally planar base or back 36 and an upwardly projecting support section or arm 37 integrally joined to the base by a web 39. A hanger section 40 is joined to the web 39 and includes a slotted tubular section 41, an elongated handle 43 and a depending skirt 45. The lower portion of the base 35, the web 39 and a portion of the tubular section 41 cooperate to define a downwardly opening groove or engaging section 47. The tubular section 41 has an elongated groove 49 defined by a generally cylindrical section which opens via a slot 51 to the exterior of the upper mounting member. The upper end of the base 35 forms a curl 53, and the lower end of the base terminates in a bead 55.

The lower mounting member 19 has an upwardly opening groove 57 which includes a cylindrical section 59 and a slot 61.

In the embodiment illustrated, each of the strips 21 is construed of a transparent plastic, with each of the strips having upper and lower ends and longitudinal edges 63. The upper and lower ends of each of the strips 21 terminate in a bead 65 of larger cross-sectional area than the adjacent portion of the strip. One corner at the upper edge and one corner at the lower edge of each of the strips 21 define an inclined edge 67. As shown in FIG. 3, the adjacent portion of the strip 21 is offset radially from the bead 65, and the slot 51 is similarly offset from the central portion of the groove 49. The lower beads 65 and the groove 57 are similarly configured as shown in FIG. 2.

The strips 21 are quickly and easily assembled into the mounting members 17 and 19 by sliding the beads 65 into the grooves 49 and 57, respectively. The offset of the beads 65 assures that each of these beads can be inserted into the associated groove 49 and 57 in only one direction. Accordingly, this assures that any curve in the plastic strips 21 will extend in the same direction and provide a better appearing strip curtain. The opposite ends of the mounting members 17 and 19 can be closed, as desired, with removable stops or plugs 69 to prevent inadvertent removal of the strips 21. The inclined edges 67 provide the necessary space for the plugs 69. If one of the strips 21 becomes damaged, it can be quickly and easily replaced. Of course, a strip 21 may comprise one or more individual strip sections, i.e., each of the strips 21 may itself be vertically or longitudinally slit to provide multiple strip sections.

The upper mounting member 17 can be installed into the strip support 23 as shown in FIG. 3 by inserting the curl 53 upwardly behind the end portion 31 of the upper flange 27 and then rotating the lower region of the upper mounting member inwardly and sliding the upper mounting member downwardly to seat the lower end of the base 35, including the bead 55, behind the end portion 31 of the lower flange 27. By reversing this procedure, the upper mounting member 17 can be removed from the strip support curtain 23.

When the upper mounting member 17 is removed from the strip support 23, it can be hung on an adjacent mounting member **17*a* as shown in FIG. 4. Specifically, the engaging section 47 receives and rests on the support arm 37*a* of the adjacent upper mounting member 17*a*. This exposes a large region of the opening 15 to permit, for example, cleaning or stocking of the shelves of the refrigerated display case 11**.

Although an exemplary embodiment of the invention has been shown and described, many changes, modifications and substitutions may be made by one having ordinary skill in the art without necessarily departing from the spirit and scope of this invention.

I claim:

1. A strip curtain for use over the opening of a display case, said strip curtain comprising:

an elongated upper mounting member;

first means for releasably mounting the upper mounting member on supporting structure;

a plurality of elongated flexible strips, each of said strips having longitudinal edges;

means for mounting the strips on the upper mounting member;

a lower mounting member;

means for attaching the strips adjacent the lower ends thereof to the lower mounting member;

said upper mounting member including a support section and an engaging section, said sections being configured and arranged such that said upper mounting member can be demounted from the first means and hung on a similar mounting member by placing the engaging section of the upper mounting member in contact with the support section of said similar mounting member; and said upper mounting member including a base, a web projecting outwardly from said base, said support section projecting generally upwardly from said web, a hanger section depending from said web and including an elongated groove, said engaging section including portions of said base, web and hanger sections which cooperate to define a downwardly opening groove and said strips include enlargements adjacent their upper ends adapted to be received within said groove of said hanger section.

2. A strip curtain as defined in claim 1 wherein said support section includes an upwardly projecting support arm and said downwardly opening groove is sized and configured to receive the upwardly projecting support arm.

3. A strip curtain as defined in claim 1 wherein said means for releasably mounting the upper mounting member includes an elongated strip curtain support, said strip curtain includes means on said strip curtain support and said upper mounting member for releasably mounting the upper mounting member on the strip curtain support and being responsive to predetermined relative movement between the upper mounting member and the strip curtain support for enabling the upper mounting member to be demounted from the strip curtain support.

4. A strip curtain as defined in claim 1 wherein said hanger section includes an elongated handle and a depending skirt.

5. A strip curtain for use over the opening of a display case, said strip curtain comprising:

an elongated upper mounting member;

first means for releasably mounting the upper mounting member on supporting structure;

a plurality of elongated flexible strips, each of said strips having longitudinal edges;

means for mounting the strips on the upper mounting member;

a lower mounting member;

means for attaching the strips adjacent the lower ends thereof to the lower mounting member;

said upper mounting member including a support section and an engaging section, said sections being configured and arranged such that said upper mounting member can be demounted from the first means and hung on a similar mounting member by placing the engaging section of the upper mounting member in contact with the support section of said similar mounting member; and said upper mounting member being extruded from plastic material and is relatively rigid, said upper mounting member includes a base, a web projecting outwardly from said base, said support section projecting generally upwardly from said web, a hanger section depending from said web and including an elongated groove, said engaging section including portions of said base, web and hanger sections which cooperate to define a downwardly opening groove and said strips include enlargements adjacent their upper ends adapted to be received within said groove of said hanger section, said first means includes an elongated strip curtain support adapted to be attached to supporting structure and comprising a generally channel-shaped construction having a pair of legs joined by a web with end portions of the legs being turned generally toward each other, said base of said upper mounting member being adapted to be received within said strip curtain support.

* * * * *